United States Patent [19]

Budish

[11] Patent Number: 4,524,590

[45] Date of Patent: Jun. 25, 1985

[54] DOOR LATCH WITH LOCK

[76] Inventor: Joseph D. Budish, 1635 Madison Ave., South Milwaukee, Wis. 53172

[21] Appl. No.: 421,970

[22] Filed: Sep. 23, 1982

[51] Int. Cl.[3] ..... E05B 65/06

[52] U.S. Cl. ..... 70/129; 70/134; 292/57; 292/142; 292/DIG. 21

[58] Field of Search ..... 70/134, 101, 129; 49/63, 163; 292/DIG. 21, 57, 60, 127, 142, 172

[56] References Cited

U.S. PATENT DOCUMENTS

| | | | |
|---|---|---|---|
| 156,238 | 10/1874 | Squyer | 292/57 |
| 1,159,877 | 11/1915 | Smith | 292/57 |
| 1,653,487 | 12/1927 | White | 292/142 X |
| 1,994,095 | 3/1935 | Caldwell | 70/134 X |
| 2,403,065 | 7/1946 | Engert | 292/57 |
| 2,543,171 | 2/1951 | Jaden | 292/57 |
| 4,275,910 | 6/1981 | Budish | 292/57 |

FOREIGN PATENT DOCUMENTS

| | | | |
|---|---|---|---|
| 239987 | 9/1925 | United Kingdom | 292/142 |

*Primary Examiner*—Gary L. Smith
*Assistant Examiner*—Thomas J. Dubnicka
*Attorney, Agent, or Firm*—Michael, Best & Friedrich

[57] ABSTRACT

The door latch with lock includes a support bracket adapted to be mounted on the interior surface of an outer screen or storm door, an elongated bolt slideably and rotatably carried in a guideway on the support bracket, and a transversely extending handle on the bolt which extends through a slot in the guideway and is somewhat longer than the spacing between the outer door and an inner door. When the handle is in a generally horizontal sliding position, the bolt slides freely between a latched position wherein the outer end is received in a keeper on the door frame and an unlatched position wherein the bolt is retracted from the keeper. The bolt and handle can be rotated downwardly to a general vertical locking position when the bolt is in either the latched or unlatched positions, but lock means and actuating means prevent the sliding of the bolt between the latched and unlatched positions unless the handle is rotated to the sliding position. The handle cannot be rotated to the sliding position for unlatching the bolt any time the inner door is closed. The actuation means responds to the lock means to move the bolt between the latched and unlatched position when the bolt and handle are in the locking position.

4 Claims, 5 Drawing Figures

DOOR LATCH WITH LOCK

BACKGROUND OF THE INVENTION

The invention relates to latches and, more particularly, bolt latches with locks for doors and the like.

Outer screen doors or storm doors for homes commonly are provided with some sort of inside locking mechanism which ordinarily can be easily forced open from the outside or conveniently unlatched from the outside after the glass or screen in the door has been broken through. Consequently, these locking mechanisms are not particularly effective as a deterrent to a burglar and provide very little additional security.

Bolt type latches are widely used as inside door locks because of their simple operation, low cost and effectiveness. Such latches typically include a rod or bolt mounted on a support bracket for rotational and longitudinal movement by a knob or handle on the bolt. The support bracket usually includes a slotted guideway through which the handle projects and the guideway has detents which receive the handle and serve to prevent movement of the bolt from a latched position to an unlatched position, and vice versa, unless the handle is rotated to a generally horizontal position. Exemplary prior art constructions for bolt latches are listed below:

| Patentee | U.S. Pat. No. | Issue Date |
|---|---|---|
| Engert | 2,403,065 | July 2, 1946 |
| Jaden | 2,543,171 | February 27, 1951 |
| Squyer | 156,238 | October 27, 1874 |
| Smith | 1,159,877 | November 9, 1915 |
| Kistner | 2,845,789 | August 5, 1958 |
| Pellicore | 2,924,862 | February 16, 1960 |

A bolt latch which is effective as an inside lock for outer screen or storm doors is disclosed in Budish U.S. Pat. No. 4,275,910. The Budish latch prohibits a burglar from opening the outer door by simply breaking through the glass or screen in the vicinity of the latch, reaching through the opening and rotating the handle to a horizontal or operating position, and sliding the bolt to the unlatched position. The latch in U.S. Pat. No. 4,275,910 cannot be unlocked from outside the door, however.

SUMMARY OF THE INVENTION

A principal object of the invention is to provide a latch for an outer screen or storm door and the like which, although simply constructed, cannot be unlatched as long as the inner door is closed, unless a key is used.

Another object of the invention is to provide a modified bolt type lock which is particularly adaptable for use as an inside latch on an outer screen or storm door and the like.

Other objects, aspects and advantages of the invention will become apparent to those skilled in the art upon reviewing the following detailed description, drawings and the appended claims.

The invention provides a door latch including a support bracket having a base adapted to be mounted on the interior of a door in a double door installation. An elongated bolt is carried by the support bracket for relative rotational movement and relative slideable movement between a latched position wherein the outer end of the bolt is received in a keeper, and an unlatched position, wherein the bolt is retracted from the keeper. An elongated handle is affixed on and extends transversely from the bolt for rotating the bolt and for moving the bolt between the latched and unlatched positions.

An actuation means engages the bolt and prevents longitudinal movement of the bolt between the latching and unlatching positions, when the handle and bolt are in a locking position with the handle generally vertical or extending parallel to the face of the door. The actuation means disengages the bolt when the bolt and handle are in a sliding position displaced angularly from the locking position. In the sliding position, the bolt is moveable by the handle between the latched and unlatched positions.

The actuation means is operable by a moveable lock means operable from the outer face of the screen or storm door. The actuation means moves the bolt in response to movement of the lock means between the latched and unlatched positions when the bolt is in the locking position.

The handle has a length greater than spacing between the doors. Thus, when the outer door is closed, the handle engages the other door to prevent rotation thereof to the sliding position, thereby preventing movement of the bolt from the latching position except by the lock means. The support bracket is also provided with a guide arranged to permit reciprocal longitudinal movement and rotational movement of the bolt.

DESCRIPTION OF THE PREFERRED EMBODIMENTS

Figure 3:
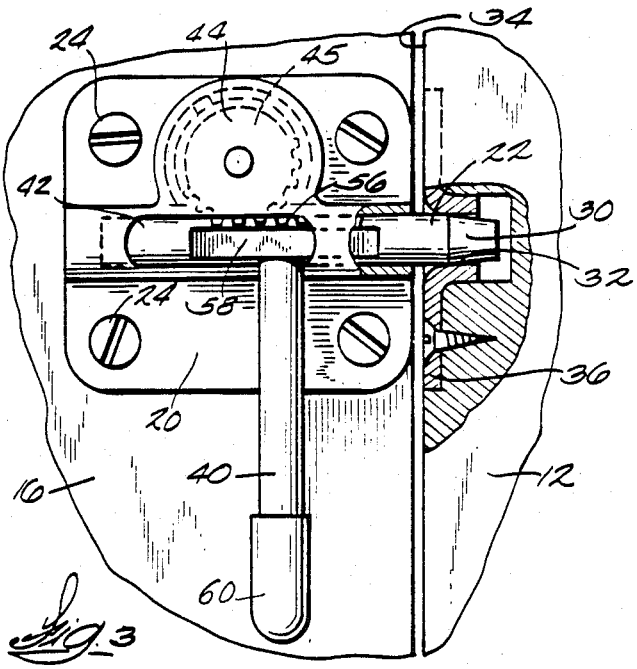
FIG. 3 is a front elevational view of the door latch taken generally along line 3—3 in FIG. 2.
Figure 2:
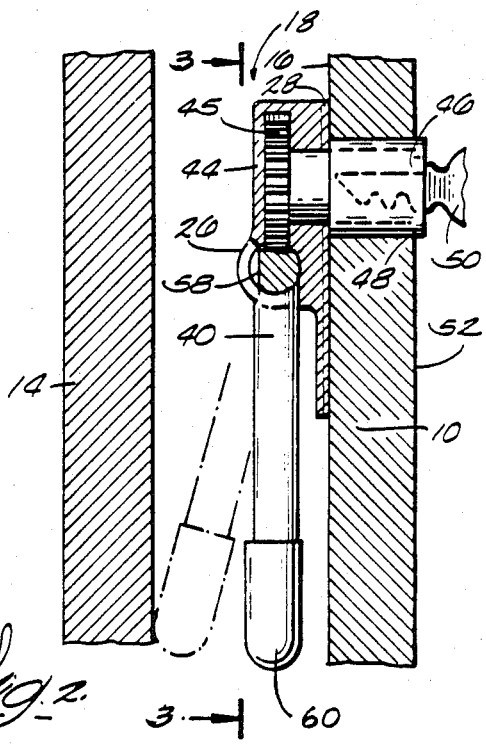
FIG. 2 is a cross sectional view of a door latch embodying the invention, shown mounted on the interior of an outer screen or storm door.
Figure 1:
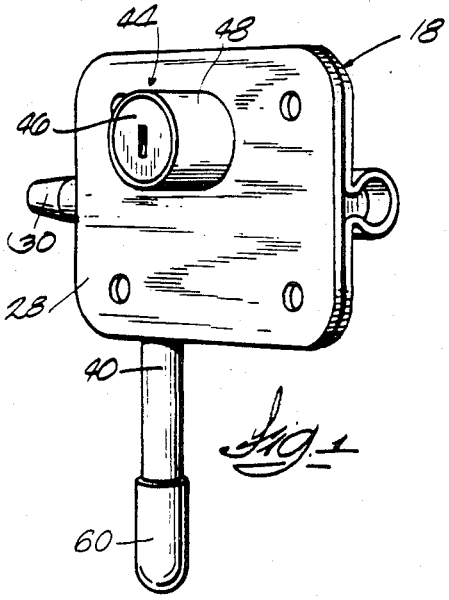
FIG. 1 is a perspective view of a door latch with a lock.

Illustrated in FIGS. 1–3 is a home door installation including an outer screen or storm door 10 hinged on a door frame 12 for outward swinging movement from the position shown. An inner door 14 is hinged on the door frame 12 for inward swinging movement from the position shown.

Mounted on the interior surface 16 of the outer door 10, between the outer and inner doors 10 and 14, is a latch 18 embodying the invention. The latch 18 includes a support bracket 20 and an elongated cylindrical rod or bolt 22 carried by the support bracket 20 for both rotational movement and slideable longitudinal movement relative to the support bracket 20. The support bracket 20 is suitably secured to the outer door 10 by threaded fasteners 24 or the like.

While various arrangements can be used, in a specific construction illustrated, the support bracket includes a generally U-shaped strap 26 which has a raised central portion and is suitably secured, such as by spot welding or the like to a base plate 28. Both the strap 26 and the base plate 28 can be conveniently stamped from a sheet metal. The raised central portion of the strap 26 cooperates with the base 28 to define a longitudinally extending channel or guideway slidably receiving the bolt 22. The bolt 22 can be moved longitudinally between a latched position shown in FIG. 3, wherein the outer end 30 is received in an aperture 32 of a keeper plate 36 mounted on the side 34 of the door frame 12 and extends into a hole drilled into the door frame, and an unlatched position wherein the outer end 30 is retracted from the keeper plate 36 to permit the outer door 10 to be opened.

Affixed on and extending generally perpendicularly from the bolt 22 is an elongated, cylindrical handle 40 for moving the bolt 22 between the latching and unlatched positions. The handle 40 extends through a longitudinally extending slot 42 provided in the raised central portion of strap 26. The slot 42 has a width large enough to permit reciprocal longitudinal movement of the bolt 22 between the latched and unlatched positions when the handle 40 is in a sliding position extending generally horizontally or perpendicularly from the plane of the base plate 28, and in a locking position displaced angularly downward from the sliding position. The slot also accommodates approximately 90 degrees rotation of the handle 40 between a horizontal position and a vertical position.

Adjacent the bolt 22, about in the midpoint of the upper portion of the base 28, is a lock means 44 for engaging the bolt 22 when the bolt 22 is in the locking position. The lock means 44 is operable through an actuating means to move the bolt 22 between the latching and unlatched positions when the bolt 22 is in the locking position. In this embodiment, the lock means 44 comprises a cylinder lock 46 inserted into and encased in a cylindrical sleeve 48 attached to and extending away from the base plate 28. The lock 46 requires a key 50 which is inserted into the lock 46 from the outside face 52 of the first door 10.

The actuating means includes a pinion gear 45 which is operably connected to the lock 46 and is rotated in response to rotation by the key 50. The pinion gear 45 engages a longitudinally extending rack 56 on one side of the bolt 22 when the bolt 22 is in the locking position. The rack 56 is located on the central portion of the bolt 22, and has a length at least as great as the longitudinal movement of the bolt 22 between the latching and unlatched position. When the key 50 is turned in the lock 46, rotational movement of the pinion gear 45 moves the bolt 22 longitudinally between the latched and unlatched positions, depending on which direction the key is turned.

Figure 4:
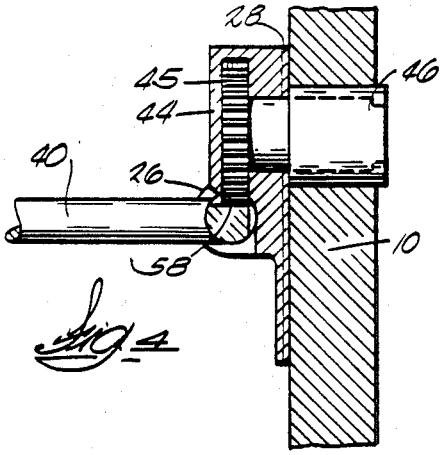
FIG. 4 is a sectional view of the bolt and handle in a sliding position.
Figure 5:
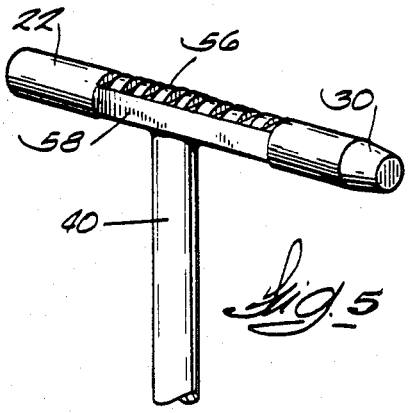
FIG. 5 is a perspective view of a bolt and handle.

The rack 56 is located on the side of the bolt 22 opposite to the handle 40, as shown in FIG. 5. The bolt 22 includes a recessed portion 58 located approximately 90 degrees from the rack 56 and extending longitudinally coextensive with the rack 56. Thus, the pinion gear 45 engages the rack 56 when the handle 40 is in the locking position and prevents longitudinal movement of the bolt unless the key 50 is turned, as shown in FIG. 2. When the handle 40 is rotated to the sliding position, the recessed portion 58 is aligned with the pinion gear 45, and the pinion gear 45 is completely disengaged from the bolt 22 so the bolt can be moved freely between the latching and unlatched positions, as shown in FIG. 4.

The handle 40 has a length somewhat greater than the spacing between the inner and outer doors 10 and 14 so that it engages the inner door 14, as shown by the dashed lines in FIG. 2, when rotational movement from the locking position to the sliding position is attempted. As a consequence, the handle 40 cannot be rotated to the sliding position, and the bolt cannot be moved from the latched position to the unlatched position when the inner door 14 is closed, unless the key 50 is used. Thus, even though a burglar might gain access to the latch handle 40 by breaking through the glass or screen in the outer door 10, he cannot move the bolt 22 to an unlatched position as long as the inner door 14 is closed. If the inner door 14 is locked, a burglar has to force open the inner door 14 before he can unlock the outer door 10. The additional time and effort required for such an operation tends to discourage unauthorized entries.

A cap 60 made from a plastic, elastomeric material or the like can be fitted over the outer end of the handle 40 to serve as a knob, and also as a bumper to minimize scratching of the inner and outer doors. The bolt 22 and the handle 40 preferably are formed as a one-piece unit or the handle 40 is secured to the bolt 22, such as by welding, prior to assembly with support bracket 20. In either case, the handle 40 is inserted through the slot, the bolt 22 slipped into the U-shaped channel defined by the raised central portion of the strap 26 and the base plate 28 thereafter secured to the strap 26. The outer end of the bolt 22 preferably is slightly tapered as illustrated to minimize binding with the keeper sleeve 34.

From the above description, it can be seen that the latch of the invention, while simply constructed, provides a positive deterrent against forced opening of an outer door. The latch can be opened by someone with a key, however, when access is desired.

While the latch has been described in conjunction with a door installation including an outwardly swinging outer door, it can also be used on either vertically sliding or horizontally sliding outer doors. In the latter case, the latch can be mounted adjacent the top or bottom edge of the outer door, with the bolt vertically oriented, and the keeper can be located in the door frame transom or the door sill or threshold. Also, it can be appreciated that the latch can be conveniently adapted for use with other double door or window installations including an outer door or window and an inner door or window. Accordingly, the term "door installation" as used herein, broadly encompasses double door and double window installations and other similar installations.

While a preferred embodiment of the invention has been illustrated and described in detail, it should be understood that the invention is not limited thereby and various modifications and alterations can be made without departing from the spirit and scope of the invention.

I claim:

1. A latch for a door installation including first and second doors having inner and outer faces and mounted in spaced facing relationships for movement relative to each other between open and closed positions, said latch comprising:

a support bracket including a base adapted to be mounted on the inner face of the first door between the first and second doors;

an elongated bolt having an outer end portion, said bolt being carried by said support bracket for relative rotational movement between a sliding position and a locking position angularly displaced from said sliding position and for relative slidable movement between a latched position wherein, when the first door is closed, said outer end portion is received in a keeper located adjacent the first door to prevent opening of the first door, and an unlatched position wherein said outer end portion is retracted from the keeper to permit opening of the first door, said bolt including a longitudinally extending rack having a length corresponding to the longitudinal movement of said bolt between the latched and unlatched positions and a recessed portion angularly displaced from said rack;

an elongated handle affixed on said bolt and extending transversely therefrom for rotating said bolt and for moving said bolt between the latched and unlatched positions and the sliding and locking positions, said handle having a length greater than the spacing between the first and second doors, whereby during attempted rotational movement of said handle and said bolt in a direction from the locking position toward the second door with the second door closed, said handle engages the face of the second door to prevent movement of said bolt to the sliding position;

movable lock means operable from the outer face of the first door;

actuation means operable in response to movement of said lock means including a pinion which engages said rack when said bolt is in the locking position to prevent longitudinal movement of said bolt without moving said lock means and to permit longitudinal movement of said bolt between the latching and unlatched positions in response to movement of said lock means, said pinion being aligned with said bolt recessed portion when said bolt is in the sliding position to permit free longitudinal movement of said bolt between the latching and unlatched positions.

2. A latch according to claim 1 wherein said lock means is key operated.

3. A latch according to claim 1 wherein said support bracket includes a portion defining a longitudinally extending guideway receiving said bolt and said guideway includes a longitudinally extending slot through which said handle extends.

4. A latch according to claim 1 including a cap of non-scratching material on the outer end of said handle.

* * * * *